US007159736B1

(12) United States Patent
Torelli

(10) Patent No.: US 7,159,736 B1
(45) Date of Patent: Jan. 9, 2007

(54) DEVICE FOR PRESERVING FRESHNESS OF CONTENTS OF A CONTAINER

(76) Inventor: Nicholas A. Torelli, 5000 N. Ocean Blvd., K25, Boynton Beach, FL (US) 33435

( * ) Notice: Subject to any disclaimer, the term of this patent is extended or adjusted under 35 U.S.C. 154(b) by 0 days.

(21) Appl. No.: 11/273,660

(22) Filed: Nov. 14, 2005

Related U.S. Application Data

(60) Provisional application No. 60/692,155, filed on Jun. 20, 2005.

(51) Int. Cl.
*B65D 25/10* (2006.01)

(52) U.S. Cl. ..... 220/578; 222/1; 220/216

(58) Field of Classification Search ..... 222/1, 222/475.1, 386, 386.5; 220/216, 225, 578, 220/579, 529
See application file for complete search history.

(56) References Cited

U.S. PATENT DOCUMENTS 1,092,902 A * 4/1914 Doggett ..... 220/578
3,578,467 A 5/1971 Huber
4,034,116 A 7/1977 Hamell et al.
4,394,919 A 7/1983 von Alven et al.
4,416,387 A * 11/1983 D'Antinio ..... 220/579
4,625,883 A * 12/1986 Burke et al. ..... 220/578
4,874,108 A * 10/1989 Valasek ..... 220/578
4,907,719 A * 3/1990 Spotholz et al. ..... 222/1
5,402,908 A * 4/1995 Warden et al. ..... 220/554
6,510,981 B1 1/2003 Deering et al.
6,514,552 B1 2/2003 Sivetz
2003/0010787 A1 1/2003 Dalton et al.

* cited by examiner

*Primary Examiner*—Lien M. Ngo
(74) *Attorney, Agent, or Firm*—Bernard S. Hoffman

(57) ABSTRACT

A device for preserving freshness of contents, such as but not limited to, coffee, paint, nuts, etc., of a container. The device includes a body and a handle. The body is free of venting bores, comes to rest on the contents of the container, and substantially engages the inner side surface of the container, to preserve the freshness of the contents of the container by blocking virtually all air in the container from contact with the contents of the container. The handle extends foldably from the body so as to self-fold onto the body and prevent interference of the handle with the lid of the container when the contents of the container are at such a level in the container that the handle would, in its normal upward position, be interfered with by the lid of the container.

4 Claims, 1 Drawing Sheet

DEVICE FOR PRESERVING FRESHNESS OF CONTENTS OF A CONTAINER

1. CROSS REFERENCE TO RELATED APPLICATIONS

Figure 1:
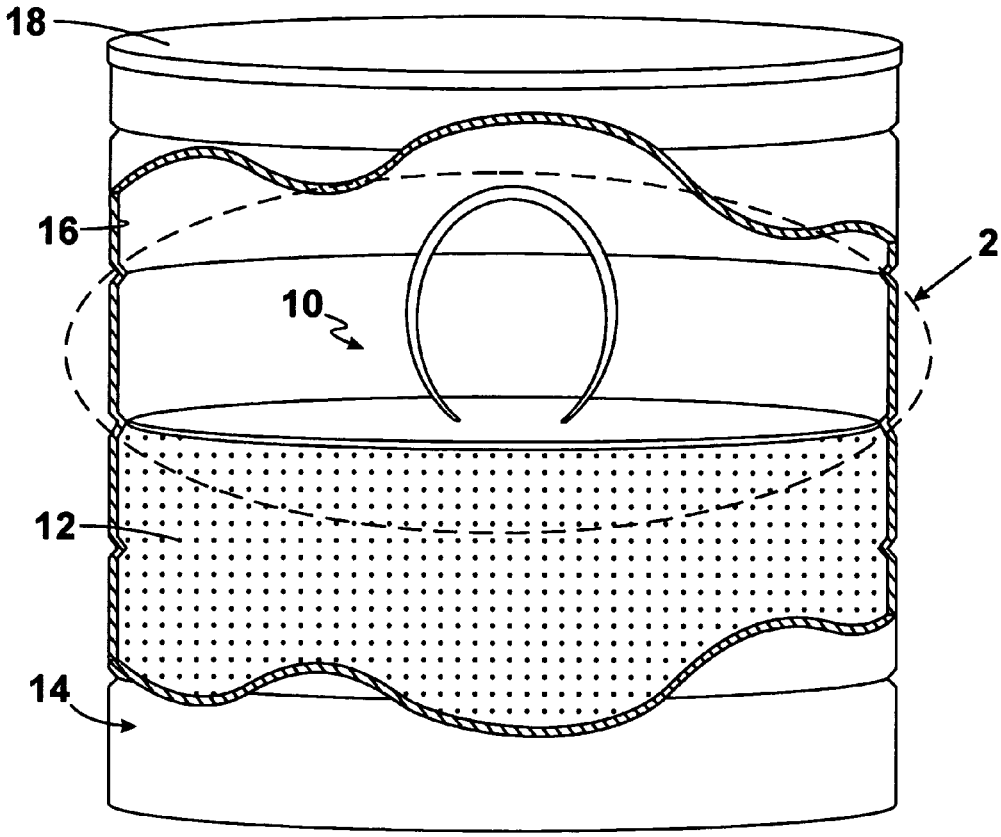

The instant non-provisional application claims priority from provisional application No. 60/692,155, filed on Jun. 20, 2005, for a FRESHNESS KEEPER, which contains subject matter contained in applicant's Disclosure Document Number 571704, filed Feb. 28, 2005, for a FRESHNESS KEEPER, which applicant requests be made a part of the file of the instant non-provisional application and be retained for more than the two allotted years.

2. BACKGROUND OF THE INVENTION

A. Field of the Invention

The present invention relates to a device for preserving freshness, and more particularly, the present invention relates to a device for preserving freshness of contents of a container.

B. Description of the Prior Art

Presently, when a can of coffee is newly opened, the coffee producer provides the consumer with a removable plastic outer cover or lid for the can. This removable plastic outer cover is intended to replace the permanent original metal cover that was removed to gain access to the new coffee grounds. The purpose of the removable plastic outer cover is to attempt to keep the unused coffee grounds fresh while in the can. Some producers now provide coffee cans with a peel-back type of seal to replace the original metal cover. This peel-back seal is to ostensibly re-seal the can of unused coffee grounds.

Once opened and exposed to the outside air, however, the coffee grounds in the can begin to lose their freshness. Moreover, the removable plastic outer cover does not necessarily provide an airtight seal as does the original metal cover nor does the peel back seal when it is re-sealed. Further, the more coffee grounds that are eventually used, the lower the level of the grounds inside the can become. This results in ever more outside air entering the can. Again, this is regardless of the plastic removable outer cover or the peel back seal. The constant addition and continuing presence of air in the can over periods of days, weeks, months, or longer causes the unused coffee grounds to lose more and more of their freshness resulting in reduced flavor and taste.

Thus, there exists a need for a device for maintaining freshness of coffee in a previously opened can. Numerous innovations for freshness packaging have been provided in the prior art that will be discussed below. Even though these innovations may be suitable for the specific individual purposes to which they address, they differ from the present invention. For example:

(1) U.S. Pat. No. 3,578,467 to Huber.

U.S. Pat. No. 3,578,467 issued to Huber on May 11, 1971 teaches a coffee container apparatus including an open top can receiving a plunger type cover that closely fits the wall of the can and is insertable downwardly there into to force the air there out and come to rest on the top of the coffee and hermetically seal air from contact therewith whereby the coffee aroma will be maintained. The cover may include an upwardly and outwardly flared, resilient, peripheral lip that deforms to conform to the can wall configuration for assuring positive hermetic sealing.

(2) U.S. Pat. No. 4,034,116 to Hamell et al.

U.S. Pat. No. 4,034,116 issued to Hamell et al. on Jul. 5, 1977 teaches rigid containers, such as metal cans, for use in hermetically packaging roasted coffee products that are coated internally with an aroma solvent—e.g. glycerides, waxes, silicones, etc.—that is effective to dissolve and partition a broad range of aromatics. This effects an aroma partition between the head-space in the sealed, coffee-containing can and the coating that retards staling and/or oxidation of the coffee aroma within the sealed can. The pick-up of aroma by the coating may also increase the amount of aroma retention within the opened container during an extended in-use period.

(3) U.S. Pat. No. 4,394,919 to von Alven et al.

U.S. Pat. No. 4,394,919 issued to von Alven et al. on Jul. 26, 1983 teaches a closure for containers, which is readily removeable in whole or in part to gain access to contents in the container. The closure includes a generally flat cap member sealed at its periphery to the mouth of the container. An upstanding tubular member on the surface of the cap is partially surrounded by a score line in the cap, and the score line preferably continues all around the cap near its periphery. The tubular member preferably has rigidifying apparatus in its closed top and side walls, which can be readily flexed inwardly so that the tubular member can be firmly grasped and pulled to readily initiate a rupture in the score line at a stress-concentrating focal point on that portion of the score line adjacent the tubular member. The cap can then be easily removed by continued pulling of the tubular member.

(4) United States Patent Application Publication Number US 2003/0010787 A1 to Dalton et al.

United States Patent Application Publication Number US 2003/0010787 A1 published to Dalton et al. on Jan. 16, 2003 teaches a fresh packaging system for roast and ground coffee having a top load capacity of at least about 16 pounds or 7.3 Kg and which includes a container with a closed bottom, an open top, and a body enclosing a perimeter between the bottom and the top. A protuberance is continuously disposed around the perimeter of the body proximate to the toe) and forms a ridge external to the body. A flexible closure is removeably attached and sealed to the protuberance so that the closure seals the interior volume of the container. The container bottom and container body are constructed from a material having a tensile modulus number ranging from at least about 35,000 to at least about 650,000 pounds per square inch or at least about 2,381 to at least about 44, 230 atm.

(5) U.S. Pat. No. 6,510,981 to Deering et al.

U.S. Pat. No. 6,510,981 issued to Deering et al. on Jan. 28, 2003 teaches a canister for containing a particulate-type product, such as a ready-to-eat cereal. The canister includes a side wall, a bottom closure, and a plastic lid. The side wall defines at least a portion of a tubular body having an upper opening, a lower opening, and an internal storage region for containing the particulate-type product. The side wall includes a first paper-based layer and a second plastic-based layer. The first paper-based layer has an inner surface and an outer surface. The second plastic-based layer is bonded to the inner surface of the first paper-based layer. The bottom closure is connected to the side wall so as to encompass the bottom opening. The plastic lid is openably secured to the tubular body at the upper opening. The plastic lid provides selective access to the internal storage region.

(6) U.S. Pat. No. 6,514,552 to Sivetz.

U.S. Pat. No. 6,514,552 issued to Sivetz on Feb. 4, 2003 teaches a method for keeping roasted coffee beans fresh. Roasted coffee bean freshness is maintained by storing just roasted beans in a sealed container having much less than 1.0% oxygen therein. Storage of roasted coffee at very low temperatures—less than −40 degrees F. or −40 degrees C.—also preserves the freshness of the coffee. The combination of low oxygen and low temperature storage provides the freshly roasted coffee taste and a long shelf life for that preserved taste.

It is apparent that numerous innovations for freshness packaging have been provided in the prior art that are adapted to be used. Furthermore, even though these innovations may be suitable for the specific individual purposes to which they address, they would not be suitable for the purposes of the present invention as heretofore described.

3. SUMMARY OF THE INVENTION

Accordingly, an object of the present invention is to provide a device for preserving freshness of contents of a container that avoids the disadvantages of the prior art.

Briefly stated, another object of the present invention is to provide a device for preserving freshness of contents, such as but not limited to, coffee, paint, nuts, etc., of a container. The device includes a body and a handle. The body is free of venting bores, comes to rest on the contents of the container, and substantially engages the inner side surface of the container, to preserve the freshness of the contents of the container by blocking virtually all air in the container from contact with the contents of the container. The handle extends foldably from the body so as to self-fold onto the body and prevent interference of the handle with the lid of the container when the contents of the container are at such a level in the container that the handle would, in its normal upward position, be interfered with by the lid of the container.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

4. BRIEF DESCRIPTION OF THE DRAWING

Figure 2:
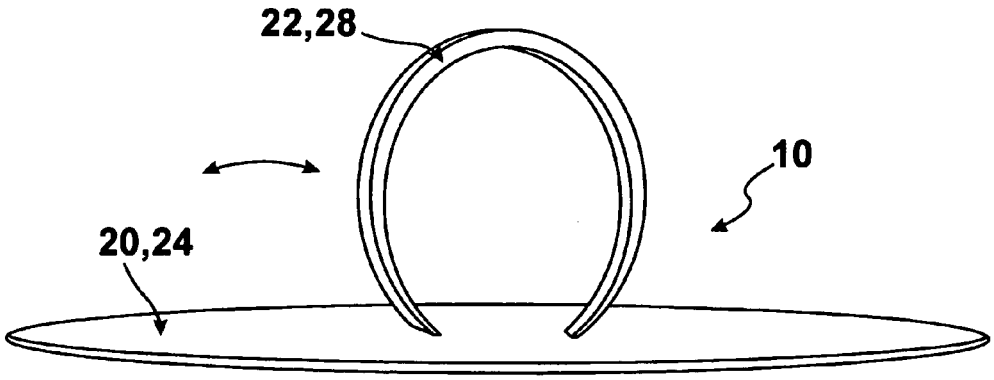

The figures of the drawing are briefly described as follows:

FIG. 1 is a diagrammatic perspective view in partial cross section of the device of the present invention preserving freshness of contents of a container; and FIG. 2 is an enlarged diagrammatic perspective view of the area generally enclosed by the dotted curve identified by ARROW 2 in FIG. 1 of the device of the present invention.

5. LIST OF REFERENCE NUMERALS UTILIZED IN THE DRAWING

10 device of present invention for preserving freshness of contents 12, such as but not limited to, coffee, paint, nuts, etc., of container 14

12 contents, such as but not limited to, coffee, paint, nuts, etc.

14 container

16 inner side surface of container 14

18 lid of container 14

20 body for coming to rest on contents 12 of container 14 and substantially engaging inner side surface 16 of container 14 to preserve freshness of contents 12 of container 14 by blocking virtually all air in container 14 from contact with contents 12 of container 14

22 handle for facilitating insertion of body 20 into container 14 and removal of body from container 14

24 disk of body 20

28 pull ring of handle 22

6. DETAILED DESCRIPTION OF THE PREFERRED EMBODIMENT

Referring now to the figures, in which like numerals indicate like parts, and particularly to FIG. 1, which is a diagrammatic perspective view in partial cross section of the device of the present invention preserving freshness of contents of a container, the device of the present invention is shown generally at 10 for preserving freshness of contents 12, such as but not limited to, coffee, paint, nuts, etc., of a container 14, wherein the container 14 has an inner side surface 16 and a lid 18.

The configuration of the device 10 can best be seen in FIG. 2, which is an enlarged diagrammatic perspective view of the area generally enclosed by the dotted curve identified by ARROW 2 in FIG. 1 of the device of the present invention, and as such, will be discussed with reference thereto.

The device 10 comprises a body 20 and a handle 22. The body 20 is for coming to rest on the contents 12 of the container 14 and substantially engaging the inner side surface 16 of the container 14 to preserve the freshness of the contents 12 of the container 14 by blocking virtually all air in the container 14 from contact with the contents 12 of the container 14. The handle 22 extends upwardly from the body 22 and is for facilitating insertion of the body 20 into the container 14 and removal of the body 20 from the container 14.

The handle 22 is preferably made of plastic, but is not limited to that, and extends foldably from the body 20 so as to allow the handle 22 to self-fold onto the body 20 for preventing interference of the handle 22 with the lid 18 of the container 14 when the contents 12 of the container 14 is at such a level in the container 14 that the handle 22 would, in its normal upward position, be interfered with by the lid 18 of the container 14.

The body 20 is a disk 24. The disk 24 is thin, flexible, free of venting bores, and preferably made of plastic, but is not limited to that.

The handle 22 is a pull ring 28. The pull ring 28 is resilient and preferably ultrasonically bonded to the body 20, but is not limited to that, and is readily self-folding onto the body 20 when interfered with by the lid 18 of the container 14.

It will be understood that each of the elements described above, or two or more together, may also find a useful application in other types of constructions differing from the types described above.

While the invention has been illustrated and described as embodied in a device for preserving freshness of contents of a container, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for preserving freshness of contents of a container, wherein the container has an inner side surface and a lid, said device comprising:

a) a body; and b) a handle;

wherein said body is for coming to rest on the contents of the container and substantially engaging the inner side surface of the container to preserve the freshness of the contents of the container by blocking virtually all air in the container from contact with the contents of the container;

wherein said handle extends upwardly from said body;

wherein said handle is for facilitating insertion of said body into the container and removal of said body from the container;

wherein said handle extends foldably from said body so as to allow said handle to self-fold onto said body for preventing interference of said handle with the lid of the container when the contents of the container is at such a level in the container that said handle would, in its normal upward position, be interfered with by the lid of the container;

wherein said body is a disk;

wherein said handle is a pull ring;

wherein said pull ring is readily self-folding onto said disk when interfered with by the lid of the container;

wherein said disk is free of venting bores;

wherein said disk has a peripheral edge;

wherein said disk is flat and smooth and radially tapers uniformly at the peripheral edge of said disk; and wherein said pull ring extends directly from said disk.

2. The device of claim 1, wherein said handle is made of plastic.

3. The device of claim 1, wherein said disk is made of plastic.

4. The device of claim 1, further comprising ultrasonic bonding; and wherein said ultrasonic bonding bonds said pull ring to said disk.

* * * * *